United States Patent [19]

Jensen

[11] 4,299,521

[45] Nov. 10, 1981

[54] APPARATUS FOR SPREADING AND FEEDING OF ARTICLES OF FLATWORK

[75] Inventor: Jørgen M. Jensen, Bierges, Belgium

[73] Assignee: Ejnar Jensen & Son A/S, Ronne, Denmark

[21] Appl. No.: 87,349

[22] Filed: Oct. 23, 1979

[51] Int. Cl.[3] ..... B08B 1/00

[52] U.S. Cl. ..... 414/13; 38/108; 38/12; 38/143

[58] Field of Search ..... 38/12, 108, 111, 143; 414/13

[56] References Cited

U.S. PATENT DOCUMENTS

| | | | |
|---|---|---|---|
| 3,092,263 | 6/1963 | Beaudry et al. | 414/13 |
| 3,198,315 | 8/1965 | Long, Sr. | 414/13 |
| 3,421,756 | 1/1969 | Weir | 38/143 |
| 3,553,861 | 1/1971 | Orpney et al. | 414/13 |
| 3,604,132 | 9/1971 | Thompson et al. | 38/143 |
| 4,143,476 | 3/1979 | Holmes et al. | 38/143 |

*Primary Examiner*—Lawrence J. Oresky

[57] ABSTRACT

Apparatus for spreading and feeding articles of flatwork such as sheets to an ironing machine and comprising a conveyor over which a beam with two movable clamps is arranged. The clamps are adapted to grip the article at two corners and to move apart to draw the upper edge of the article tight. The beam is stationary in order to simplify construction. Between the beam and the conveyor is a movable plate, onto which the upper edge of the article is transferred and from which plate the article is transferred to the conveyor by a movement of the plate in the moving direction of the conveyor.

6 Claims, 6 Drawing Figures

Figure 3:
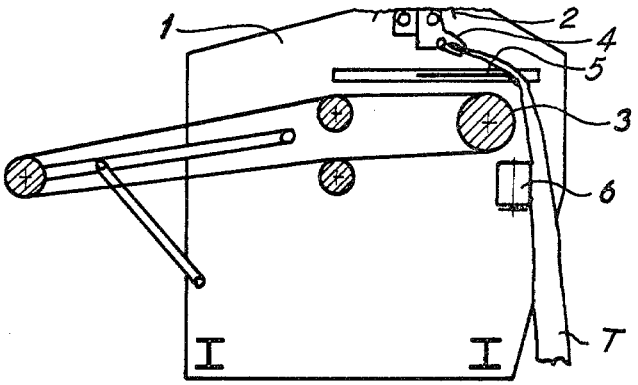

Fig. 1
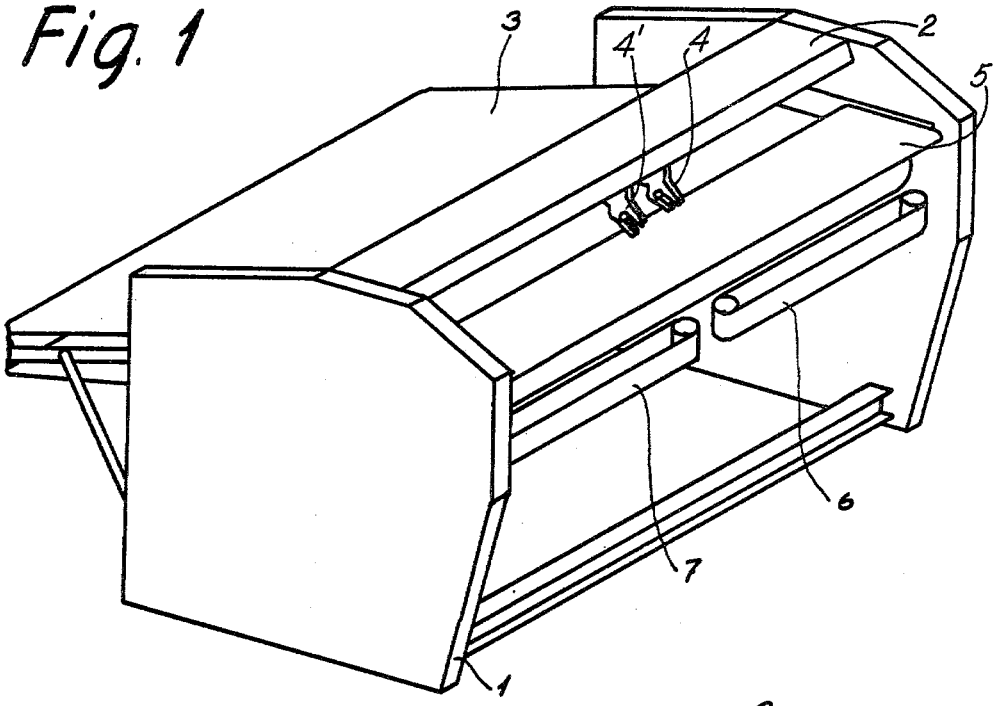
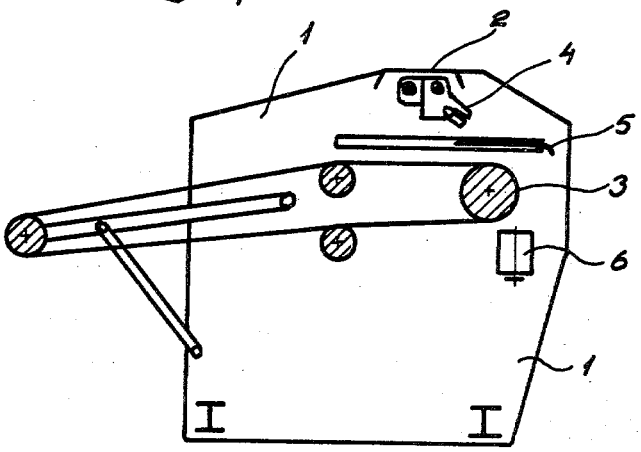
Fig. 2
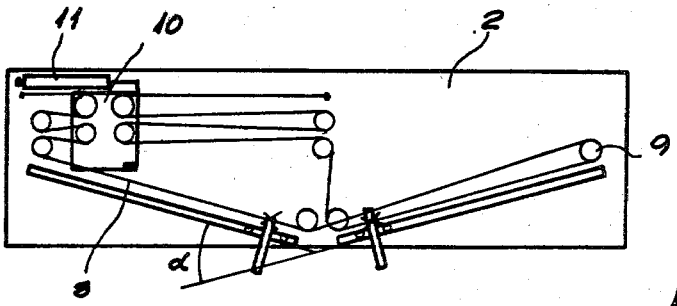
Fig. 5

APPARATUS FOR SPREADING AND FEEDING OF ARTICLES OF FLATWORK

The present invention relates to an apparatus for spreading and feeding of articles of flatwork comprising a conveyor, at the upstream end of which a beam with a pair of clamps is supported, the clamps being suited to hold a corner of an article each and to move apart until the edge of the article is tight and thereafter release the article onto the conveyor.

In a known apparatus of this type the beam is adapted to be reciprocated in such a way that the article during its insertion with the corners in the clamps is freely suspended in front of the conveyor, but when released is placed over the upstream end of the conveyor. The clamps thereby perform a complex combined movement, being at first moved apart and thereafter moved in synchronization with the conveyor, over which the releasing takes place at the end of the latter movement. For this combined movement a certain amount of time is consumed in which the operator is not able to insert another article. Besides, the complicated construction of the reciprocable beam and the considerable movable masses in it, it is a drawback for the operator to see the beam reciprocate just in front of him or her.

It is an object of the present invention to provide an apparatus, in which the abovementioned drawbacks have been reduced. According to the invention the apparatus is characterized in that above the upstream end of the conveyor and below the beam a plate is arranged, said plate being reciprocable from a first position in which the upstream end of the conveyor is covered and a second position in which the conveyor is uncovered.

During the insertion of the article in the clamps the plate is in its first position and stays in this position during the moving apart of the clamps. When the upper edge of the article is tight and the article is suspended over the edge of the plate, the plate is moved quickly to the second position simultaneously with the releasing of the clamps. The article will then drop partly on the conveyor and partly on the plate, the latter of which will, however, during its movement transfer and smooth the leading edge of the article upon its delivery to the conveyor. The movement of the plate takes place with a speed, which according to the invention is substantially greater than the speed of the conveyor. Thereafter, the clamps are moved together and the plate returns to its first position, and the apparatus is ready for a new cycle.

As the beam is preferably stationary during this cycle, the apparatus will be more comfortable for the operator.

In apparatuses of this type a pair of belts are usually provided in front of the conveyor, the outward facing parts running from the center of the apparatus to the sides. According to the invention it is preferred that the plate has a third position behind the first one and into which the plate is moved during the moving apart of the clamps, and in which third position the conveyor is covered, whereas the oppositely moving belts are free.

As soon as the article has been released from the clamps it will start its movement on the conveyor under the beam. This may involve the risk of the corners of the article inserted in the clamps being folded backwards.

According to a further aspect of the invention this drawback has been eliminated in an embodiment in which a roller is placed in front of the upstream edge of the conveyor and provided with driving means, said means being arranged to rotate the roller during the releasing of the clamps in a direction opposite the conveyor over a predetermined angle and thereafter to rotate the roller synchroneously with the conveyor.

At the release of the clamps the roller in front of the conveyor will prevent the weight of the article hanging freely in front of the apparatus from slipping out of the apparatus, and by the opposite rotation it will pull the article out of the clamps without folds. As soon as the article is free of the clamps and the plate has been removed totally from the interspace between the conveyor and the bridge the roller is driven with a speed which is substantially synchroneous with the conveyor, whereby the article will be transported without folds by the conveyor.

Figure 4:
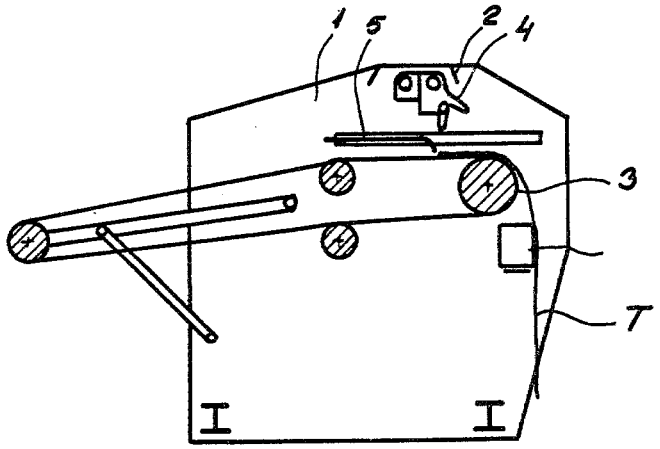
Figure 6:
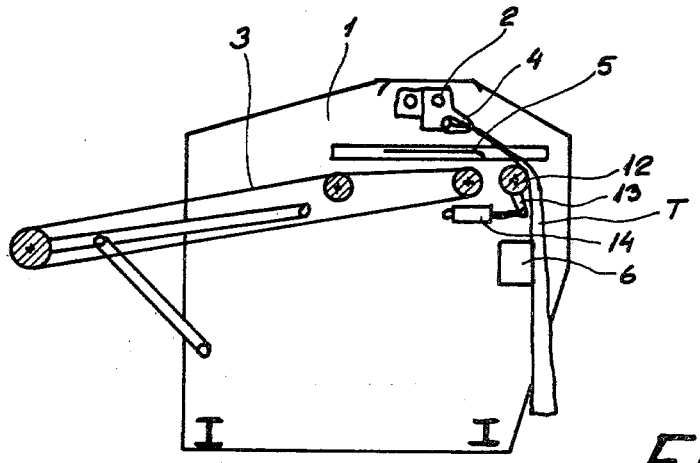

The invention will be described further in the following specification with reference to the drawing, in which:

FIG. 1 shows perspectively an embodiment of the apparatus according to the invention, FIG. 2 shows a section through the apparatus according to FIG. 1 with the plate in first position, FIG. 3 shows a section like in FIG. 2, but with the plate in third position, FIG. 4 shows a section like in FIG. 2, but with the plate in second position, FIG. 5 schematically shows an embodiment of the spreading mechanism in the beam seen from above, and FIG. 6 shows an embodiment of the apparatus according to the invention with a roller in front of the conveyor.

The apparatus according to the invention comprises as shown in FIG. 1 a frame with side plates 1 connected at their upper edges by means of a beam 2. Between the side plates a horizontal conveyor 3 is mounted, on which conveyor articles of flatwork are spread and fed, for example to an ironing machine or folding apparatus. On the beam above the upstream end of the conveyor a pair of slidable clamps 4,4' are mounted, each adapted when the clamps are adjacent to each other to receive a corner of the article to be spread out and transferred to the conveyor 3. The two clamps are arranged to horizontally move apart along the beam 2 after the insertion of the upper corners of the article so that the flatwork drapes downwardly from the clamps until the edge of the article is drawn tightly and thereafter to release the article. In order to prevent the article before being spread from being pulled up by the conveyor a horizontally slidable plate 5 (sometimes referred to as a flatwork carrier means) is provided and which, during the insertion of the article, may serve as a working surface and onto which the article after being spread out is dropped and transferred. As soon as the transfer to the plate 5 has taken place, the plate 5 is adapted to perform a quick movement in the direction of the conveyor (i.e. at a speed greater than the conveyor), by which movement the space under the beam is free to receive the released article as it falls down onto the conveyor. Immediately after this movement, the plate is in a fully retracted position (FIG. 4) over the conveyor when the article on the conveyor 3 passes under the plate. As soon as the clamps 4,4' have returned to the position close to each other, the operator may insert another article in the clamps, even if the trailing edge of the first article has not passed under the plate.

In order to make sure that quick and complete spreading takes place, it is preferred that under the upstream edge of the conveyor a pair of oppositely driven belts 6,7 is arranged, the portions facing outwardly running from the center to the sides to spread and smooth out the draped portion of the article to contact the same.

The operation of the apparatus will be explained by means of the FIGS. 2–4 showing a longitudinal section through the apparatus. In FIG. 2 the apparatus is ready for the insertion of the upper corners of the article T of a draped flatwork article in the adjacently positioned pair of clamps 4. The plate 5 is in its fully extended first position, in which its front edge is in front of the conveyor 3 and the pair of belts 6,7 so that the draped article is spaced from the belts 6, 7 and conveyor. As soon as both clamps are closed and the trailing edge of a possible preceeding article has passed under the plate, the apparatus starts the spreading procedure when the pair of clamps are moved apart. The plate 5 is then moved a short distance in the direction of the conveyor as shown in FIG. 3, in order to expose the belts, 6, 7 and bring the draped portion of the article T against the belts 6, 7. Simultaneously, the pair of clamps 4 are moved apart until the edge of the article is drawn tightly.

Sensing means, for example a photo cell, detects when the upper edge of the article is drawn tightly and releases the clamps 4, dropping the article T on the plate 5, which thereafter performs a quick movement backwards to its fully retracted position over the conveyor 3, at a speed greater than the conveyor speed so that the plate moves away from the leading edge of the article as the draped portion of the article is pulled against its roller 3 (FIG. 4). The plate immediately thereafter returns to its fully extended first position—the starting position—the clamps being simultaneously moved together above the center of the conveyor.

In FIG. 5 a driving arrangement for the pair of clamps 4 is shown. It may be preferred that the path of the clamps forms an angle allowing the clamps to be situated further up the conveyor when moved apart than in the position where the article insertion takes place.

The clamps in the pair of clamps 4 are fastened to different portions of a cable loop 8, which is guided by a number of free running pulleys 9 in such a way that the clamps move symmetrically in respect of each other. The cable further passes over a number of freely running pulleys arranged on a slide 10 in such a way that a conversion ratio is obtained between the movement of the slide and the pair of clamps. The slide may be driven by means of, for example, a pneumatic cylinder 11.

In FIG. 6 a longitudinal section through a modified apparatus according to the invention is shown. The construction corresponds to the apparatus described above, modified in that a roller 12 is arranged in front of the upstream edge of the conveyor. The other parts correspond to the elements in the above apparatus and consequently have the same reference numbers.

The roller 12 is arranged to be driven substantially synchroneously with the conveyor, which may be arranged by a common chain driving the roller via a friction clutch. The roller is furthermore arranged to be stopped and to be driven through a predetermined angle in the opposite direction. The driving means for this opposite drive may be a brake, the moment arm of which is provided with driving means for the opposite drive, for example by connecting the moment arm 13 with the frame by means of a pneumatic cylinder 14.

The operation of the apparatus according to the invention is that the roller 12 is stopped after the clamps 4 have moved apart. The plate 5 is moved a short distance in the direction of the conveyor, whereby the roller is uncovered, said roller is rotated oppositely through an angle corresponding to a linear movement of 2–10 cm. The clamps are simultaneously released, the article T dropping onto the plate 5 when the plate reaches the position in which the interspace between the beam and the conveyor is free, the synchroneous forward drive of the roller 12 is started, the article being conveyed through the apparatus. The plate is then returned to its starting position, while the trailing edge of the article is transported under the plate 5 as described above in connection with the FIGS. 1–4.

I claim:

1. In apparatus for spreading and feeding of articles of flatwork, said apparatus comprising a horizontally extending conveyor, a pair of clamps supported for operative movement only transversely of the conveyor, and which are reciprocated between adjacent positions opposite a middle portion of the conveyor where the clamps are accessible from the front of the conveyor for connection of the upper corners of a flatwork piece to extend downwardly from the clamps in front of the upstream end of the conveyor and spaced apart positions where the upper end of the clamped flatwork piece is taut prior to release thereby from the clamps, the improvement comprising flatwork piece carrier means reciprocable between an extended forward position below the path of movement of the clamps and a retracted rear position above the conveyor and behind the upstream end thereof, said carrier means in its extended forward position engaging a portion of the flatwork piece extending down from the clamps and holding the same out of engagement with said conveyor, at least a part of said carrier means in the path of movement of said carrier means between said extended and retracted positions being positioned beneath the clamps so that the clamped taut upper end of the flatwork piece can fall thereupon upon release of the flatwork piece from the clamps, and said carrier means during its return to said retracted position pulling the flatwork piece upon the conveyor and then losing engagement therewith so that the leading end of the flatwork piece also drops upon the conveyor.

2. Apparatus according to claim 1, characterized in that a roller is placed in front of the upstream edge of the conveyor and provided with driving means, said means being arranged to rotate the roller during the releasing of the clamps in a direction opposite the conveyor over a predetermined angle and thereafter to rotate the roller synchronously and in the same direction as the conveyor.

3. Apparatus according to claim 2, characterized in that the driving means includes a brake, the momentum arm of which is connected with a pneumatic cylinder for driving the roller in the direction opposite of the conveyor, and a friction clutch for driving the roller synchroneously with the conveyor.

4. The apparatus of claim 3, wherein the speed of movement of the flatwork carrier means in its movement to said retracted position is greater than the speed of the conveyor, so that the carrier means pulls away from the leading end of the flatwork piece so that the leading end of the flatwork piece drops in a flattened condition upon the conveyor.

5. The apparatus of claim 1 in which there is provided a pair of oppositely, outwardly horizontally driven belts arranged in front of the upstream end of the conveyor to engage and smooth the portion of the flatwork piece contacting the same, said flatwork carrier means in said extended position thereof holding the flatwork piece away from said oppositely driven belts as well as the conveyor during the attachment of the upper corners of the flatwork piece to said clamps, the portion of the flatwork piece then extending downwardly from said clamps engaging said outwardly driven belts and conveyor during the movement of said carrier means from said extended position to said retracted position.

6. The apparatus of claims 1, 4 or 5, wherein said clamps are located above the upstream end of the conveyor and said carrier means is mounted for movement in a substantially horizontal plane below said clamps and above the conveyor.

* * * * *